US006427614B1

(12) United States Patent
Bott et al.

(10) Patent No.: US 6,427,614 B1
(45) Date of Patent: Aug. 6, 2002

(54) SEWING MACHINE WITH A VENTILATION WHEEL AND A ROTATION SPEED SENSOR ATTACHED TO AN ELECTRIC MOTOR

(76) Inventors: Michael Bott, Strahlerweg 38, Karlsruhe 76227; Uwe Winkler, Merkurweg 12, Ettlingen 76275, both of (DE)

( * ) Notice: Subject to any disclaimer, the term of this patent is extended or adjusted under 35 U.S.C. 154(b) by 0 days.

(21) Appl. No.: 09/857,935

(22) PCT Filed: Sep. 10, 2000

(86) PCT No.: PCT/EP00/09897

§ 371 (c)(1),
(2), (4) Date: Sep. 20, 2001

(87) PCT Pub. No.: WO01/27374

PCT Pub. Date: Apr. 19, 2001

(30) Foreign Application Priority Data

Oct. 11, 1999 (DE) ..... 199 49 020

(51) Int. Cl.[7] ..... D05B 69/24; G01D 5/34

(52) U.S. Cl. ..... 112/275; 112/220; 112/453

(58) Field of Search ..... 112/270, 275, 112/277, 220, 221, 453, 470.01

(56) References Cited

U.S. PATENT DOCUMENTS

| | | | | |
|---|---|---|---|---|
| 3,995,156 A | | 11/1976 | Angersbach et al. | |
| 4,438,718 A | | 3/1984 | Hanyu | |
| 4,692,676 A | * | 9/1987 | Dohi et al. | 112/275 X |
| 5,176,085 A | * | 1/1993 | Hara et al. | 112/275 |

FOREIGN PATENT DOCUMENTS

| | | |
|---|---|---|
| DE | 2 227 116 | 12/1972 |
| DE | 3 600 938 | 8/1987 |

* cited by examiner

*Primary Examiner*—Peter Nerbun

(57) ABSTRACT

In connection with an electric motor (12) used for operating a sewing machine, which has a fan wheel (17) and a speed sensor (25), the fan wheel (17) and the screen disk (18) of the speed sensor (25), as well as a belt pulley (19) of the belt drive (10), are combined into a multi-function wheel (15).

4 Claims, 2 Drawing Sheets

SEWING MACHINE WITH A VENTILATION WHEEL AND A ROTATION SPEED SENSOR ATTACHED TO AN ELECTRIC MOTOR

BACKGROUND OF THE INVENTION

The invention relates to a sewing machine in accordance with the preamble of claim 1.

A rotational speed sensor is required for the operation of an electronically-controlled sewing machine, which is used for regulating the engine speed, for one, and at least one position sensor is furthermore employed, with the aid of which the angular position of the main shaft, and therefore the position of the needle bar, is determined.

A device for a sewing machine, called a pulse sensor, is known from DE 36 00 938 C1, which contains three concentrically arranged scanning tracks with a multitude of scanning markers on a screen disk, wherein the latter is arranged inside of the sewing machine housing on a shaft which rotates with the main shaft of the sewing machine. The outer one of the three scanning tracks is assigned to a speed sensor. By means of this assignment, a maximum number of scanning markers which can be scanned per unit of time is achieved, if the narrowest possible width of the scanning markers is utilized. Since the quality of regulation of the number of revolutions increases with an increasing number of scanning pulses available per unit of time, there are two options for increasing the quality of regulation, namely to increase the diameter of the screen disk and the corresponding scanning track and in this way to increase the number of scanning markers, and/or to drive the screen disk at a rotational speed which is greater in comparison with the main shaft of the sewing machine.

Since generally there is only little space available inside the sewing machine housing, it would be a solution to house at least the scanning track assigned to the speed sensor, or the screen disk, on the motor shaft either inside the motor housing or in the immediate vicinity of the motor housing.

An electric motor used for operating a sewing machine is known from DE-OS 2 227 116, which is flanged to the outside of the machine housing and is in a driven connection with the main shaft of the sewing machine by means of a coupling. Inside its housing, in the area of the coupling, the motor contains a fan wheel, which is driven by the motor shaft, and in the opposite end area a speed sensor and two position sensors at an axial distance. Even though the axial distance between the speed sensor and the two position sensors is small, there is a noticeable increase of the motor housing in the axial direction because of the three sensors being housed there. Such a step could possibly not be realizable in connection with a built-in motor—such as is customary with household sewing machines—because of the restricted space conditions in the sewing machine housing.

SUMMARY OF THE INVENTION

The object of the invention is to arrange the speed sensor, and at least one position sensor, of a sewing machine, which is driven by means of an electric motor having a fan wheel, in such a way that, on the one hand, a large number of scanning markers per unit of time is available for the regulation of the number of revolutions and, on the other hand, its space-saving housing is assured. The object is attained by means of the characterizing features of claim 1.

Because of the step of combining the fan wheel of the motor and the screen disk of the speed sensor into a multi-functional wheel, and therefore to design a component of the motor which is provided anyway in such a way, that it performs a second additional function, the axial structural length of this motor is not increased in spite of the now integrated speed sensor.

Since moreover the at least one control segment disk of the position sensor is not arranged in or on the motor, but on the main machine shaft, or on a shaft driven synchronously with it, and therefore the structural length of the motor is not also affected by the position sensor, the motor embodied in accordance with the invention is particularly suited as a built-in motor.

By means of the further development in accordance with claim 2, wherein the fan wheel has an outer ring and the screen disk is arranged in the form of a toothed ring on the circumferential Side of the ring, it is possible to arrange a maximum number of scanning markers embodied as teeth, or tooth gaps.

If the motor is in driven connection with the main machine shaft by means of a belt drive, it is possible in accordance with claim 3 to embody the belt pulley assigned to the motor shaft as a component of the multi-function wheel.

Since in connection with an indirect drive, i.e. a drive by means of a belt drive, or possibly also a toothed gear, of the sewing machine, the motor shaft generally rotates at a higher speed than the main machine shaft, it is possible in this way to further increase the number of scanning markers available per unit of time.

A concrete measure for the secure fastening of the multi-function wheel is recited in claim 4.

BRIEF DESCRIPTION OF THE DRAWINGS

The invention is explained by means of an exemplary embodiment represented in the drawings, which show in.

PREFERRED EMBODIMENT OF THE INVENTION

Figure 1:
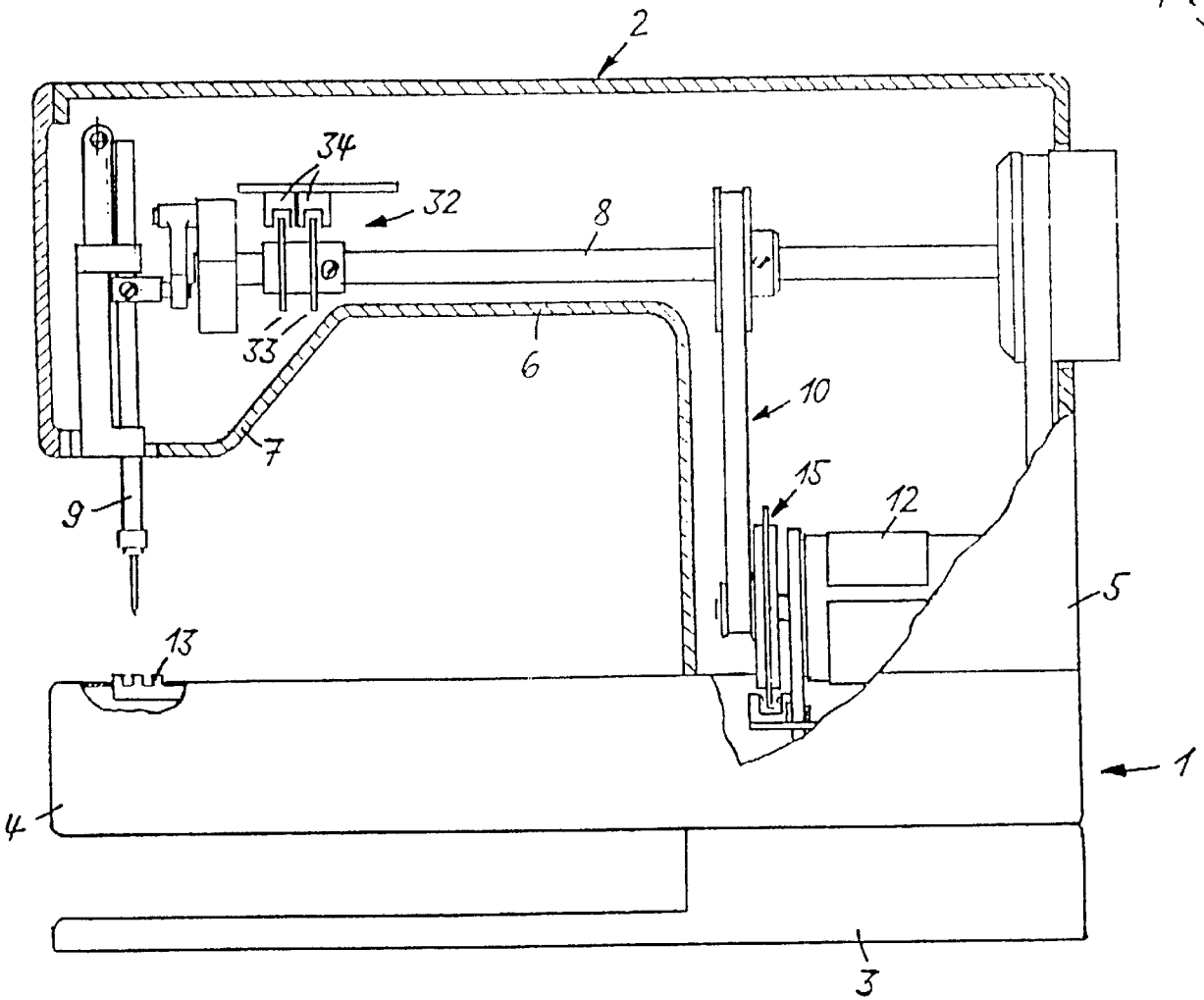
FIG. 1, a partially sectional plan view of a sewing machine.
Figure 2:
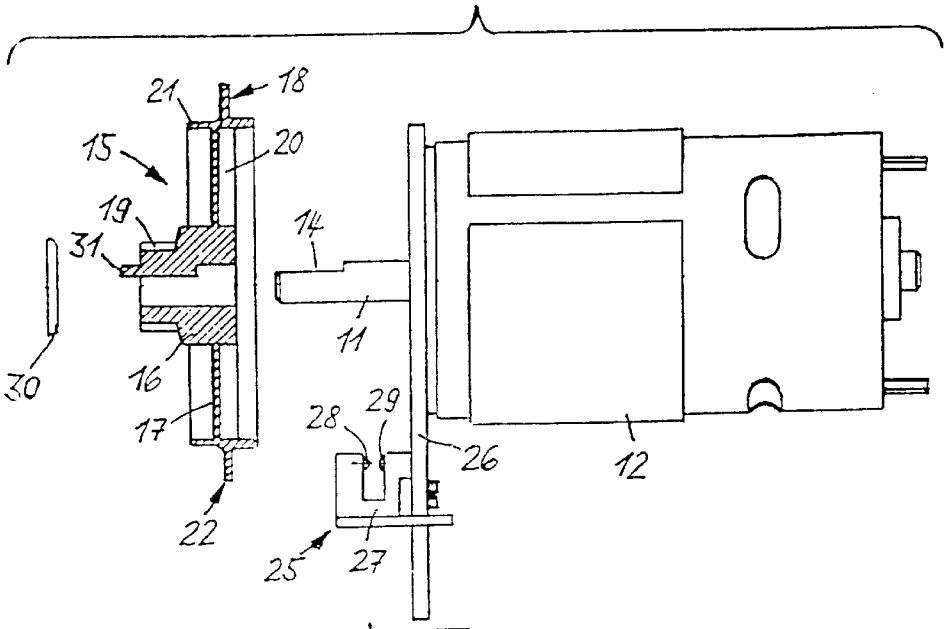
FIG. 2, a motor with a multi-function wheel and a speed sensor in a partially disassembled state, FIG. 3, a plan view of the multi-function wheel and of the speed sensor, and FIG. 4, an enlarged partial sectional view of the motor shaft and the hub of the multi-function wheel.
Figure 3:
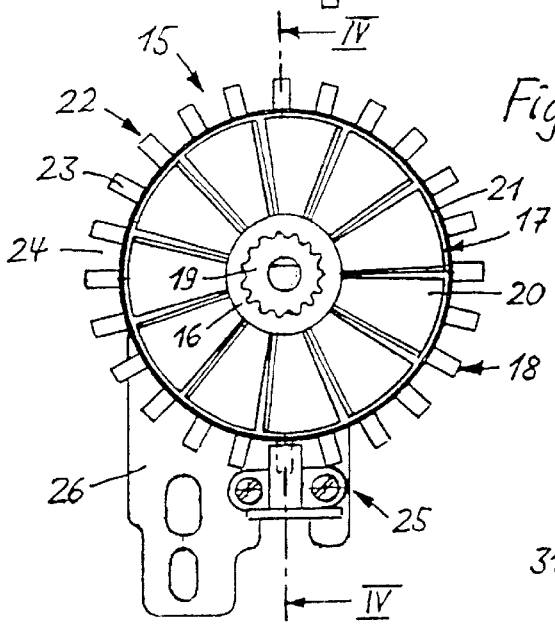
Figure 4:
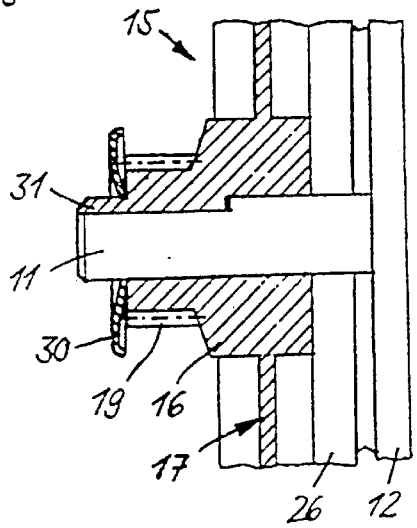

The sewing machine 1 has a housing 2, which is composed of a base 3, a free arm 4, a stand 5 and an arm 6, which makes a transition into a head 7.

A main shaft 8, which drives a pendulously suspended needle bar 9 in a known manner, is seated in the arm 6. The main shaft 8 is in a driven connection via a toothed belt drive 10 with the shaft 11 of an electric motor 12 installed inside the stand 5. The main shaft 8 drives, in a known and therefore not further explained manner, a shaft, not represented, which is arranged in the free arm 4 and by means of which a material feeder 13 and a gripper, not represented, are driven.

On the motor shaft 11 provided with a flattening 14, a multi-function wheel 15, whose hub 16 is matched to the flattening 14, is arranged. The multi-function wheel 15 is a one-piece injection-molded element and consists of a fan wheel 17, a ring-shaped screen disk 18 and a belt pulley section 19.

The fan wheel 17 has a multitude of vanes 20, which are enclosed in an outer ring 21. The screen disk 18 in the form of a toothed ring 22 is arranged on the circumference of the ring 21, wherein the individual teeth 23, or tooth gaps 24, form scanning markers for a speed sensor 25.

The speed sensor 25 has a U-shaped housing 27 fastened on a motor support plate 26 which, in a manner similar to the speed sensor from DE 36 00 938 C1, contains a light transmitter 28 and a light receiver 29. In the mounted state, the toothed ring 22 passes between the light transmitter 28 and the light receiver 29, wherein the change between the release and the blockage of the light beam is processed as a pulse relevant to the rotational speed by means of a known, not further explained evaluation circuit.

The belt pulley section 19 is formed laterally of the fan wheel 17 on the hub 16. In one direction the axial position of the multi-function wheel 15 is fixed by the step of the flattening 14, and is assured in the other direction by a lock washer 30, which is supported by frictional connection with the motor shaft 11. A shoulder 31 which is formed on the wheel hub 16 is used for the secure fixation of the lock washer 30, and projects laterally from the hub 16 and fills the flattening 14 in the area of the lock washer 30 sufficiently, so that a common circular cross section results.

A position sensor 32 is assigned to the main shaft 8. It has two control segment disks 33 fastened on the main shaft 8, to which a scanning device 34, consisting of one light transmitter and one light receiver each, is assigned. The position sensor 32 processes the release and blockage of the light beams caused by the rotating control segment disks 33 in a known manner into position-relevant pulses, for example for the material feeder switching movement and the lateral needle bar movement.

What is claimed is:

1. A sewing machine (1) with an electric motor (12), having a fan wheel (17) and provided for driving the main shaft (8) of the sewing machine (1), with a rotational speed sensor (25), which scans a screen disk (18), and with a position sensor (32), which scans at least one control segment disk (33), for determining the actual angular position of the main shaft (8), characterized in that the fan wheel (17) and the screen disk (18) for the speed sensor (25) are combined into a multi-function wheel (15), and that the at least one control segment disk (33) of the position sensor (32) is arranged on the main shaft (8).

2. The sewing machine in accordance with claim 1, characterized in that the fan wheel (17) has an outer ring (21), and the screen disk (18) in the form of a scanning marker toothed ring (22) is arranged on the circumference of the ring (21).

3. The sewing machine in accordance with claim 2, wherein the electric motor (12) is in a driven connection with the main shaft (8) via a belt drive (10), characterized in that the belt pulley (19) assigned to the motor shaft (11) is a further component of the multi-function wheel (15).

4. The sewing machine in accordance with claim 1, wherein the motor shaft (11) has a flattening (14) for the fastening, fixed against relative rotation, of the multi-function wheel (15), and the bore of the wheel hub (16) is appropriately embodied, characterized in that the wheel hub (16) has an axially projecting shoulder (31), which fills the flattening (14) of the motor shaft (11) for dependably holding a lock washer (30), which fixes the axial position of the multi-function wheel (30).

* * * * *